United States Patent [19]

Knorr

[11] 4,307,915

[45] Dec. 29, 1981

[54] GEAR RACK FOR LONGWALL MINING MACHINE

[75] Inventor: Volker Knorr, Sprockhövel, Fed. Rep. of Germany

[73] Assignee: Gebr. Eickhoff Maschinenfabrik und Eisengiesserei mbH, Bochum, Fed. Rep. of Germany

[21] Appl. No.: 140,276

[22] Filed: Apr. 14, 1980

[30] Foreign Application Priority Data

Apr. 12, 1979 [DE] Fed. Rep. of Germany ..... 2914861

[51] Int. Cl.[3] ..... E21C 29/02

[52] U.S. Cl. ..... 299/53; 74/422; 299/43

[58] Field of Search ..... 299/42, 43, 51–54, 299/45; 74/422; 105/29 R

[56] References Cited

U.S. PATENT DOCUMENTS 4,183,585 1/1980 Brennan ..... 299/43

FOREIGN PATENT DOCUMENTS 2754862 6/1979 Fed. Rep. of Germany ..... 299/43

*Primary Examiner*—Ernest R. Purser

*Attorney, Agent, or Firm*—Thomas H. Murray

[57] ABSTRACT

A gear rack for a longwall mining machine characterized in having a width permitting the arms which carry the cutter drums of the mining machine to move to lower positions relative to a face conveyor such that low seams of coal may be mined. The rack comprises a plate extending along the face conveyor and has driving pin extensions which extend from one face of the plate to engage a driving gear or gears on the mining machine.

8 Claims, 3 Drawing Figures

GEAR RACK FOR LONGWALL MINING MACHINE

BACKGROUND OF THE INVENTION

As is known, a longwall mining machine traverses a coal seam and has two rotating cutter heads at opposite ends of the machine which cut and remove the coal and direct it onto a face conveyor extending along the path of travel of the mining machine. In certain types of longwall installations, the mining machine is caused to traverse the coal seam by means of a driven gear which engages a gear rack extending along the face side of the aforesaid conveyor.

In U.S. Pat. No. 4,166,652, a longwall mining machine is disclosed for use in low coal seams which includes a machine support rack along the working face side and a guide bar along the stowing side. The two cutting drums of the machine are carried at the machine ends and are vertically adjustable by means of adjustable arms positioned above the working face wall of the aforesaid conveyor. The mining machine bears on only one track positioned on the working face side of the conveyor and is guided by the aforesaid guide bar along the stowing side of the conveyor. The machine is caused to move along the coal seam by means of two driving gears which engage a gear rack on the working face side of the conveyor.

In a longwall mining machine of the type described above, it is necessary for the center of gravity of the machine to be situated as closely as possible to the guiding track on the working face side of the conveyor. This is necessary so as not to impair the stability of the conveyor. Those parts of the mining machine nearest the face conveyor are, therefore, disposed directly above the conveyor. Specifically, the cutter drum support arms are disposed above the face conveyor or above the gear rack which is disposed on the working face side of the conveyor. As a result, longwall mining machines of this kind can be used only in seams with a minimum thickness of approximately 3 feet, because the lowest pivoting position of the support arms is restricted by the presence of the gear rack on the working face side of the conveyor beneath the support arms. In the lowest position of the leading pivoting support arm, the cutter drum which it carries must still be capable of cutting free the coal or other material extending to the bottom edge of the face conveyor over its entire length. As a result, this lower position of the support arm defines the minimum cutter drum diameter which, in turn, defines the minimum thickness of a seam on which such a longwall mining machine can be used.

A reduction of the cutter drum diameter, which would enable a longwall mining machine to operate in seams less than 3 feet in thickness, can be achieved only if it becomes possible to extend the adjustability of the drum support arm toward the mine floor such that the drum diameter can be reduced to the dimension defined by the top edge of the machine.

In U.S. Pat. No. 4,082,361 a gear rack is disclosed for guiding a longwall mining machine which comprises two elongated strips or plates between which extend gear rack pins designed to engage a driving gear on a longwall mining machine. Such a gear rack, however, limits the extent to which the cutter drum support arms can be lowered and, hence, limits their use in low coal seams.

British Pat. No. 1,367,055 discloses a gear rack for longwall mining machines comprising a quadrilateral section, subdivided into individual portions, which is provided with bores disposed at specific pitch distances from each other. Each bore is intended to receive one bolt; while all bolts have a length which exceeds the width of the quadrilateral profiled section and are supported so as to be longitudinally slideable in the bores. The bolts are pushed through the bores by the longwall mining machine with the aid of a shoe which slides on the side of the quadrilateral profiled section which is remote from the driving gear of the mining machine. The bolt ends which project from the bores on the other side of the quadrilateral profiled section serve to engage the mining machine driving gear which rolls along the aforesaid gear rack.

The gear racks described in the foregoing publications both have relatively large widths. In the gear rack disclosed in U.S. Pat. No. 4,082,361, the width is defined by the two lateral strips or plates which carry the gear rack pins between them. In the type of gear rack disclosed in the British patent specification, the width is defined by the width of the quadrilateral profiled section which must be dimensioned such that the bolts, which are slideably supported therein and project beyond the width of the profiled section, continue to be retained in their working positions in which they project from the profiled section by more than the width of the driving gear. As a result, both types of gear racks limit the downward movement of the drum-cutter support arms.

SUMMARY OF THE INVENTION

It is an object of the present invention to provide a gear rack of reduced width for use with longwall mining machines, whereby the arms on the machine which carry the cutter drums can be lowered to a greater extent to accommodate low coal seams.

Specifically, the gear rack of the invention comprises a plate extending along the face conveyor for a longwall mining machine and having a height approximating that of the conveyor. Driving pin extensions extend from one face of the plate for engaging the driving gear on the machine, the driving pin extensions being spaced from each other at identical pitch distances and projecting outwardly from the plate over a width slightly exceeding the width of the driving gear.

The width of a gear rack constructed in accordance with the teachings of the invention is substantially less than that of prior art gear racks. Furthermore, it offers the advantage of being open on the side which is distal from the face conveyor such that when used on the working face side, it offers less resistance to the shifting motion of the face conveyor which may be obstructed by debris. In this regard, the teeth of the mining machine driving gear engaging the extensions on the conveyor can push out any debris disposed in the gear rack from its open side.

Preferably, the driving pin extensions do not extend to the bottom of the gear rack plate and are formed with bottom and side surfaces which are convex. The convex bottom surface prevents jamming of the mining machine shoe which slides beneath the extensions and the convex side surfaces improve tooth engagement. The top surfaces of the extensions should be flush with the plate top edge and form a plane surface therewith on which the mining machine can be supported, where appropriate, by means of its skids or by means of rollers.

Preferably, the plate of the gear rack beneath the aforesaid driving pin extensions is provided with a strip extending over the entire length of the plate, this strip being disposed above the bottom of the plate. When necessary, a mining machine traversing track can then be welded into the spaces beneath the strip to support and guide the mining machine if it cannot be supported on the gear rack.

The above and other objects and features of the invention will become apparent from the following detailed description taken in connection with the accompanying drawings which form a part of this specification, and in which.

Figure 1:
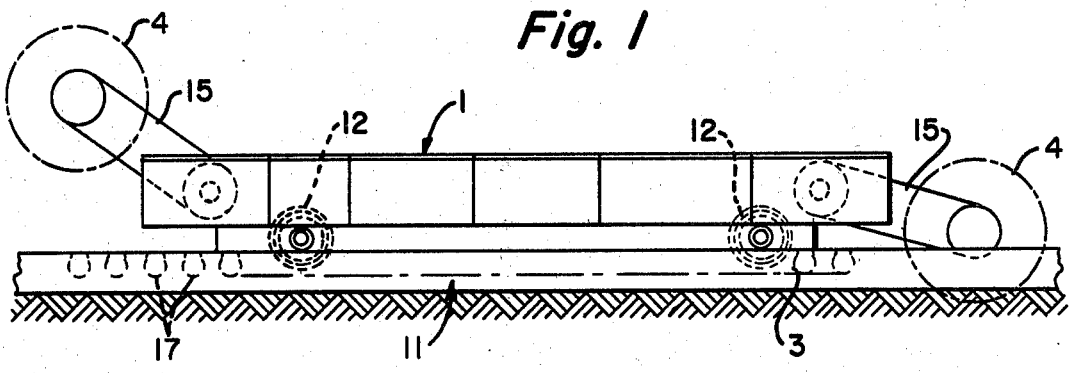
FIG. 1 is a side view of a longwall mining machine and face conveyor with which the present invention may be used.
Figure 2:
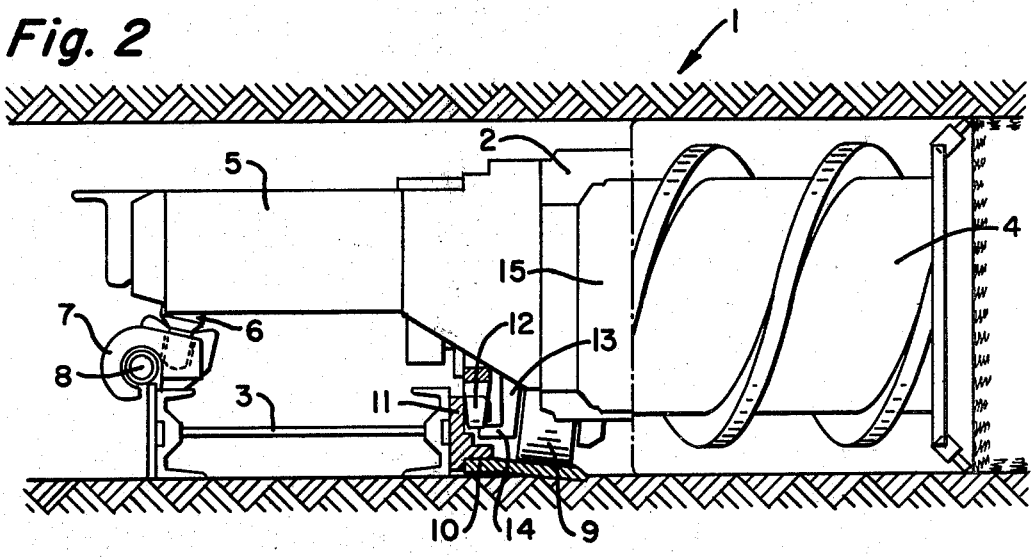
FIG. 2 is an end view of the mining machine of FIG. 1.

With reference now to the drawings, and particularly to FIGS. 1 and 2, the longwall mining machine is identified generally by the reference numeral 1 and includes a machine body 2 provided with pivotal arms 15 at its opposite ends. The arms 15 carry rotary cutter drums 4 which cut loose the material to be mined and convey it backwardly onto a face conveyor 3 as the machine traverses the face area of the mine. Machine frame 5 of the mining machine extends over the face conveyor 3 as shown in FIG. 2 and on the stowing side is provided with guide skids 7 which grip a tubular guide rail 8 and are actuated by means of double-acting hydraulic jacks 6. On the face side of the conveyor 3, the mining machine is provided with rollers 9 which traverse a track 10. As will be seen, the track 10 is structurally combined with the gear rack 11 of the invention.

Movement of the mining machine along the face conveyor 3 is achieved by means of one or more driving gears 12 which engage driving pin extensions 17 (FIG. 3) on the gear rack 11. To insure good engagement of the driving gears 12 with the gear rack, two guide shoes 13 are provided at opposite ends of the machine and have claws 14 which pass under the driving pin extensions 17. It is necessary that the cutter drums 4 remove all the material to be mined down to the bottom of the face conveyor 3. Accordingly, in low coal seams where the diameters of the cutter drums are limited, the gear rack 11 cannot prevent downward movement of the arms 15.

Figure 3:
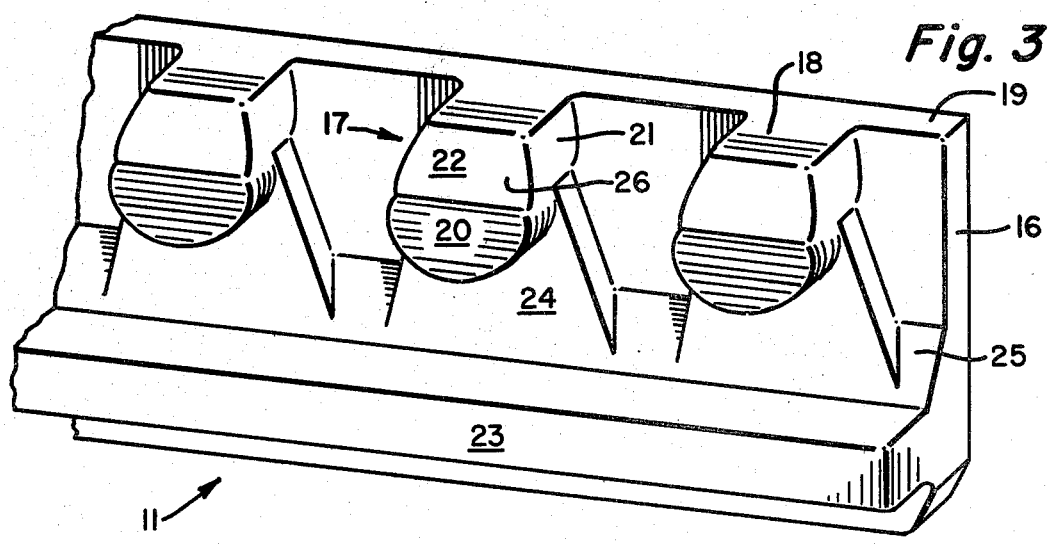
FIG. 3 is a perspective view of a portion of the gear rack of the present invention.

The gear rack of the present invention is illustrated in FIG. 3. It comprises a plate 16 having a height corresponding to the height of the face conveyor 3 and provided with tooth-like rigid extensions 17 which only slightly exceed the width of the driving gear 12 which engages them. The extensions 17 are disposed at identical pitch distances from each other on the side of the plate 16 which is distal from the face conveyor. These extensions 17 extend to the top edge of the plate 16 where their top surfaces 18 are in flush alignment with the top edge 19 of the plate to form a plane surface on which the mining machine can bear and on which it can be guided. All extensions 17 have a downwardly-curved bottom portion 20 which terminates above the plate bottom edge, and side surfaces 21 in the top part 22 of each extension which are constructed in an involute shape. The top part 22 of each extension is provided with a sloping surface 26 which is included in a direction toward the plate 16.

A strip 23 is disposed beneath the extensions 17 and entends over the entire length of the gear rack 11 above the bottom edge of the plate 16. The spacing between the bottom edge of the plate 16 and the strip 23 corresponds approximately to the thickness of the machine traversing track 10 which is welded to the plate beneath the strip 23. Each of the extensions 17 is provided with a reinforcement 24 which broadens trapezoidally from the extension to the strip 23. A sloping surface 25, inclined away from the strip 23, insures additional reinforcement of the strip 23. The gear rack of the invention can be an integral drop forging or casting and can be formed from a plurality of sections welded end-to-end.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A gear rack disposed on one side of a face conveyor for a longwall mining machine and adapted to be engaged by a driving gear on the mining machine, said gear rack comprising a plate extending along the face conveyor and having a height approximating that of the conveyor, and driving pin extensions extending from one face of the plate in cantilever relationship for engaging said driving gear, said driving pin extensions being spaced from each other at identical pitch distances and projecting outwardly from the plate over a width slightly exceeding the width of the driving gear.

2. The gear rack of claim 1 wherein said driving pin extensions extend to the top of said plate but not to the bottom thereof.

3. The gear rack of claim 1 wherein the bottom and side surfaces of said driving pin extensions are convex.

4. The gear rack of claim 3 characterized in that said side surfaces have an involute shape.

5. The gear rack of claim 3 wherein the top surface of each driving pin extension is flush with the top edge of said plate and forms a plane surface therewith.

6. The gear rack of claim 5 wherein the surfaces of said extensions opposite said plate are chamfered toward the plate.

7. The gear rack of claim 1 including a strip projecting outwardly from said plate beneath said driving pin extensions, said strip extending over the entire length of said plate and being spaced from the bottom edge thereof.

8. The gear rack of claim 7 including reinforcing means on said plate beneath each of said driving pin extensions.

* * * * *